US009290906B2

(12) United States Patent
Kobayashi et al.

(10) Patent No.: US 9,290,906 B2
(45) Date of Patent: Mar. 22, 2016

(54) CONSTRUCTION MACHINE

(75) Inventors: Takahiro Kobayashi, Tsuchiura (JP); Tsuyoshi Nakamura, Tsuchiura (JP); Kensuke Sato, Tsuchiura (JP); Hiroyuki Azuma, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 102 days.

(21) Appl. No.: 13/979,580

(22) PCT Filed: Jan. 10, 2012

(86) PCT No.: PCT/JP2012/050260
§ 371 (c)(1),
(2), (4) Date: Jul. 12, 2013

(87) PCT Pub. No.: WO2012/096255
PCT Pub. Date: Jul. 19, 2012

(65) Prior Publication Data

US 2013/0294876 A1 Nov. 7, 2013

(30) Foreign Application Priority Data

Jan. 14, 2011 (JP) ..... 2011-006234

(51) Int. Cl.
*E02F 9/08* (2006.01)
*E02F 3/30* (2006.01)

(52) U.S. Cl.
CPC ..... *E02F 9/0866* (2013.01); *E02F 3/30* (2013.01); *E02F 9/0883* (2013.01); *F01N 2340/04* (2013.01); *F01N 2590/08* (2013.01); *F01N 2610/02* (2013.01); *F01N 2610/14* (2013.01)

(58) Field of Classification Search
CPC ..... E02F 9/0866; E02F 3/30; E02F 9/0883; F01N 2340/04; F01N 2610/14; F01N 2610/02; F01N 2590/08
See application file for complete search history.

(56) References Cited

U.S. PATENT DOCUMENTS 6,390,770 B1 * 5/2002 Takeshita ..... 415/119
6,481,748 B1 * 11/2002 Okuda ..... E02F 9/0833 280/755

(Continued)

FOREIGN PATENT DOCUMENTS

CN 100441835 C 12/2008
CN 101501278 A 8/2009

(Continued)

OTHER PUBLICATIONS

Chinese Office Action dated Sep. 30, 2014 (Six (6) pages).
Japanese Office Action dated Mar. 11, 2014 (two (2) pages).
International Search Report dated Apr. 10, 2012 with English translation (two (2) pages).

*Primary Examiner* — Paul N Dickson
*Assistant Examiner* — Joselynn Y Sliteris
(74) *Attorney, Agent, or Firm* — Crowell & Moring LLP

(57) ABSTRACT

To provide a construct ion machine in which the temperature of a battery and aqueous urea within an aqueous urea tank can be prevented from rising and high stability can be secured in the vehicle body.

A small turning type hydraulic excavator (1) including: a counterweight (6) disposed at the rear of a turning upperstructure (3) provided with a front work machine (4) in the front thereof; an engine (5*a*) disposed within an engine room (5) in front of the counterweight (6); a heat exchanger (15) exchanging heat with the engine (5*a*); a fan (16) introducing outside air from an intake port (5*b*) formed in the exterior of the engine room (5) into the engine room (5) to cool the heat exchanger (15); a tail pipe (20) disposed on the exterior of the engine room (5); an aqueous urea tank (12) storing aqueous urea that purifies the exhaust gas discharged from the engine (5*a*); and batteries (13*a*, 13*b*) supplying electric power to the engine (5*a*), wherein: both the aqueous urea tank (12) and the batteries (13*a*, 13*b*) are disposed on an upstream side of the heat exchanger (15) in a flow direction of the outside air.

3 Claims, 10 Drawing Sheets

(56) References Cited

U.S. PATENT DOCUMENTS

| | | | | |
|---|---|---|---|---|
| 6,922,990 | B2 * | 8/2005 | Naruse et al. | 60/414 |
| 7,647,767 | B2 | 1/2010 | Osaku et al. | |
| 7,810,597 | B2 * | 10/2010 | Imashige | E02F 9/18 180/69.2 |
| 8,037,963 | B2 | 10/2011 | Nishimura et al. | |
| 8,317,889 | B2 * | 11/2012 | Kobayashi et al. | 55/385.3 |
| 8,403,099 | B2 * | 3/2013 | Yokota | B60K 15/063 180/309 |
| 8,573,646 | B2 * | 11/2013 | Kamiya | B60K 13/04 180/89.2 |
| 8,646,553 | B2 * | 2/2014 | Watanabe | B60K 11/04 180/68.2 |
| 2003/0056404 | A1 * | 3/2003 | Iwasa | E02F 9/0866 37/347 |
| 2009/0283346 | A1 * | 11/2009 | Katae | B60K 1/04 180/68.2 |
| 2010/0156079 | A1 * | 6/2010 | Nakashima | B60K 11/06 280/755 |
| 2010/0266458 | A1 | 10/2010 | Takeshita et al. | |

FOREIGN PATENT DOCUMENTS

| | | | |
|---|---|---|---|
| JP | 10-266261 | A | 10/1998 |
| JP | 2001-279715 | A | 10/2001 |
| JP | 2003-20936 | A | 1/2003 |
| JP | 2006-224812 | A | 8/2006 |
| JP | 2008-240678 | A | 10/2008 |
| JP | 2009-138526 | A | 6/2009 |
| JP | 2010-138849 | A | 6/2010 |

* cited by examiner

CONSTRUCTION MACHINE

TECHNICAL FIELD

The present invention relates to a construction machine having an aqueous urea tank for storing aqueous urea that purifies exhaust gas discharged from an engine, and a battery for supplying electric power to the engine.

BACKGROUND ART

A construction machine such as a hydraulic excavator is generally provided with a travel base which has a crawler belt or the like to travel, a turning upperstructure which is disposed above the travel base and connected thereto through a turning frame so as to turn in a left/right direction, and a work device which is provided in front of the turning upperstructure, such as a front work device which has actuators so as to perform work such as excavation. In addition, the construction machine has a counterweight which is provided at the rear of the turning upperstructure, and an engine room which is disposed in front of the counterweight.

The engine room has an engine, a heat exchanger which exchanges heat with the engine, an intake port which is formed in the exterior of the engine room to take in the outside air therethrough, a fan which introduces the outside air from the intake port into the engine room to cool the heat exchanger, and a tail pipe which is provided on the exterior of the engine room to release exhaust gas discharged from the engine to the outside.

Here, harmful nitrogen oxide is contained in the exhaust gas discharged from the engine. It is therefore necessary to reduce the nitrogen oxide to thereby decompose the nitrogen oxide into water and nitrogen and reduce the concentration of the nitrogen oxide contained in the exhaust gas before the exhaust gas is discharged to the atmosphere. To that end, the construction machine has an exhaust gas purifying device in the engine room. The exhaust gas purifying device reduces and purifies nitrogen oxide contained in exhaust gas.

For example, this exhaust gas purifying device includes an aqueous urea tank for storing aqueous urea, a reduction catalyst provided in an exhaust duct, and an injection device disposed in the exhaust duct on an upstream side of the reduction catalyst to inject the aqueous urea supplied from the aqueous urea tank into the exhaust duct. The aqueous urea injected by the injection device is hydrolyzed by the heat of the exhaust gas so that nitrogen oxide contained in the exhaust gas can be decomposed to harmless water and nitrogen and purified by reduction reaction between ammonia produced by the hydrolysis and the nitrogen oxide in the reduction catalyst.

For the aforementioned aqueous urea tank storing the aqueous urea that purifies the exhaust gas, various layouts have been proposed in consideration of the behavior of the aqueous urea, the dimensions of the aqueous urea tank etc. and in accordance with the usage site, purpose or the like of the construction machine. For example, since the melting point of the aqueous urea is about −11° C., the aqueous urea tank may be disposed near a device such as the engine or the hydraulic pump generating heat in the engine room so as to prevent the aqueous urea stored in the aqueous urea tank from being frozen due to the temperature decrease of the outside air. Alternatively, the aqueous urea tank may be disposed within the counterweight in order to acquire a space in the engine room.

Specifically, as one of background-art techniques about the construction machine provided with the aqueous urea tank, there has been known a construction machine in which a heat exchanger, a fan disposed to face the heat exchanger so as to generate cooling wind for accelerating heat release from the heat exchanger, and an aqueous urea tank for storing a liquid reductant, that is, aqueous urea to be supplied to an NOx reduction catalyst are provided in a machine room, and the aqueous urea tank is disposed on an upstream side of the heat exchanger in the flow direction of the cooling wind, in order to prevent the aqueous urea in the aqueous urea tank from reaching a high temperature (for example, see Patent Literature 1). In this construction machine, the aqueous urea tank releases heat to the cooling wind which has not yet passed the heat exchanger, so that the temperature rise of the aqueous urea in the aqueous urea tank can be suppressed while the aqueous urea can be prevented from being frozen.

CITATION LIST

Patent Literature

Patent Literature 1: JP-A-2009-138526

SUMMARY OF INVENTION

Technical Problem

Here, a construction machine such as a hydraulic excavator is generally provided with a battery for supplying electric power to devices such as an engine, and the battery is mounted within a turning upperstructure. However, it is not preferable that the battery is placed in a portion that may reach a high temperature, for example, near a device such as an engine or a hydraulic pump generating heat, in the same manner as the aforementioned background-art aqueous urea tank for the construction machine disclosed in Patent Literature 1. It is therefore necessary to make consideration about the layout of the battery within the turning upperstructure.

Particularly when the aqueous urea tank is disposed on the upstream side of the heat exchanger in the flow direction of the cooling wind in the engine room as in the aforementioned background-art construction machine, it may be considered that the battery is placed in a tool box in a front portion of the vehicle body. When the construction machine is middle-sized or larger, the battery may be able to be placed in the tool box in the front portion of the vehicle body. However, devices such as a control valve have been already placed in the tool box in the front portion of the vehicle body when the construction machine is a small-sized construction machine such as a small turning type hydraulic excavator. It is therefore difficult to place the battery in the tool box.

It can be also considered that a recess portion for storing an aqueous urea tank is provided in a counterweight in a small-sized construction machine such as a small turning type hydraulic excavator, and the aqueous urea tank is placed in the recess portion of the counterweight so as to secure a space for placing a battery in an engine room. However, in order to be able to perform work even in a narrow site, the tail radius of the small-sized construction machine such as a small turning type hydraulic excavator is reduced so that the counterweight does not have a large thickness. Therefore, it is difficult to secure the recess portion with a volume large enough to store the aqueous urea tank in the counterweight.

Further, in the small-sized construction machine such as a small turning type hydraulic excavator, a cast counterweight having a high specific gravity is used to reduce the tail radius. Therefore, even when the aqueous urea tank can be placed in the recess portion which is provided in the counterweight, there is a fear that the vehicle body becomes unstable because the aqueous urea tank having a different specific gravity is mounted in the recess portion of the counterweight. Thus, in the aforementioned background-art construction machine disclosed in Patent Literature 1, the layout of the battery is not taken into consideration, but the importance of the layout of the aqueous urea tank and the battery grows particularly in a small-sized construction machine such as a small turning type hydraulic excavator.

The present invention is accomplished in consideration of such actual circumstances of the background art. An object of the invention is to provide a construction machine in which the temperature of a battery and aqueous urea within an aqueous urea tank can be prevented from rising and high stability can be secured in the vehicle body.

Solution to Problem

In order to attain the aforementioned object, according to the invention, there is provided a construction machine including: a turning upperstructure which is provided with a work device in the front thereof; a counterweight which is disposed at the rear of the turning upperstructure; an engine room which is disposed in front of the counterweight; an engine which is disposed within the engine room; a heat exchanger which exchanges heat with the engine; an intake port which is formed in the exterior of the engine room to take in outside air therethrough; a fan which introduces the outside air from the intake port into the engine room to cool the heat exchanger; a tail pipe which is disposed on the exterior of the engine room to release exhaust gas discharged from the engine to the outside; an aqueous urea tank which stores aqueous urea that purifies the exhaust gas discharged from the engine; and a battery; characterized in that: both the aqueous urea tank and the battery are disposed on an upstream side of the heat exchanger in a flow direction of the outside air (in a flow direction of cooling wind).

According to the invention configured thus, the outside air is taken into the engine room through the intake port formed in the exterior of the engine room so that the temperature on the upstream side of the heat exchanger in the flow direction of the outside air may be made close to the temperature of the atmosphere by the taken-in outside air. Thus, when both the aqueous urea tank and the battery are disposed on the upstream side of the heat exchanger in the flow direction of the outside air, the aqueous urea tank and the battery can be cooled by the outside air taken in through the intake port even if the aqueous urea tank and the battery are disposed in a portion which may reach a high temperature in the engine room, for example, near a device such as the engine or the hydraulic pump generating heat. It is therefore possible to suppress the temperature rise in the aqueous urea within the aqueous urea tank and the battery.

In addition, both the aqueous urea tank and the battery are placed in the engine room so that the counterweight can ensure enough weight to keep balance in the vehicle body. Thus, the balance in the vehicle body can be kept even when the construction machine is provided with both the aqueous urea tank and the battery. In this manner, the temperature rise in the aqueous urea within the aqueous urea tank and the battery can be suppressed while high stability can be secured in the vehicle body.

In addition, according to the invention, there is provided a construction machine in the aforementioned configuration, characterized in that: the battery is disposed on a side more closely to the work device than the aqueous urea tank. With the configuration made thus, a space for placing the aqueous urea tank therein is secured at the rear of the battery, that is, on a side more closely to the counterweight than the battery. Here, the counterweight provided in a small-sized construction machine such as a small turning type hydraulic excavator has a shape with complicated irregularities internally in order to secure predetermined weight. In addition, the aqueous urea tank is, for example, molded out of a synthetic resin material with a high corrosion resistance or molded out of stainless steel or the like. Therefore, the aqueous urea tank has a degree of freedom in its shape. Thus, the shape of the aqueous urea tank can be set in conformity to the irregular shape of the counterweight in the aforementioned space in which the aqueous urea tank is disposed. In this manner, a new dead space can be prevented from being formed due to both the aqueous urea tank and the battery disposed on the upstream side of the heat exchanger in the flow direction of the outside air. Thus, the space within the engine room can be used effectively.

In addition, according to the invention, there is provided a construction machine in the aforementioned configuration, characterized in that: the battery is disposed between the aqueous urea tank and the heat exchanger. With the configuration made thus, the aqueous urea tank is disposed on an outer side than the battery, that is, on a side more closely to the exterior of the engine room. Accordingly, when an openable and closeable door for maintenance work which is formed, for example, in the exterior of the engine room and on the upstream side of the heat exchanger in the flow direction of the outside air is opened, one can stretch his/her hand to the supply port of the aqueous urea tank easily. In this manner, it is possible to save the labor and time required for the maintenance work including supply with aqueous urea etc. in the aqueous urea tank.

In addition, according to the invention, there is provided a construction machine in the aforementioned configuration, characterized in that: the battery is disposed above the aqueous urea tank. With the configuration made thus, a space corresponding to the size of the battery can be secured newly on a turning frame in comparison with the case where the aqueous urea tank and the battery are disposed side by side. Accordingly, for example, the volume of the aqueous urea tank can be set to be larger by the space corresponding to the size of the battery and secured on the turning frame. Thus, an enough quantity of aqueous urea can be stored in the aqueous urea tank.

In addition, according to the invention, there is provided a construction machine in the aforementioned configuration, characterized in that: another battery the same as the battery is further provided; and one of the two batteries is disposed above the other battery. With the configuration made thus, a space corresponding to the size of one battery can be secured on the turning frame in comparison with the case where the aqueous urea tank and the two batteries are disposed side by side on the turning frame. Accordingly, for example, the volume of the aqueous urea tank can be set to be larger by the space corresponding to the size of one battery and secured on the turning frame. Thus, an enough quantity of aqueous urea can be stored in the aqueous urea tank. Further, in comparison with the case where the two batteries are disposed above the aqueous urea tank, the aqueous urea tank and the two batteries can be prevented from interfering with the flow of the outside air taken in through the intake port in the exterior of the engine room.

Advantageous Effects of Invention

According to the invention, there is provided a construction machine including: a turning upperstructure which is provided with a work device in the front thereof; a counterweight which is disposed at the rear of the turning upperstructure; and an engine room which is disposed in front of the counterweight. The construction machine also includes: an engine which is disposed within the engine room; a heat exchanger which exchanges heat with the engine; an intake port which is formed in the exterior of the engine room to take in outside air therethrough; a fan which introduces the outside air from the intake port into the engine room to cool the heat exchanger; a tail pipe which is provided on the exterior of the engine room to release exhaust gas discharged from the engine to the outside; an aqueous urea tank which stores aqueous urea that purifies the exhaust gas discharged from the engine; and a battery which supplies electric power to the engine; wherein: both the aqueous urea tank and the battery are disposed on an upstream side of the heat exchanger in a flow direction of the outside air. Accordingly, the aqueous urea tank and the battery are cooled by the outside air taken in through the intake port so that the temperature rise in the aqueous urea within the aqueous urea tank and the battery can be suppressed. In addition, since both the aqueous urea tank and the battery are placed in the engine room, a recess portion for placing the aqueous urea tank therein does not have to be provided in the counterweight. Thus, the counterweight can ensure enough weight to keep balance in the vehicle body so that the balance in the vehicle body can be kept. In this manner, the temperature rise in the aqueous urea within the aqueous urea tank and the battery can be suppressed while high stability can be secured in the vehicle body. Thus, the reliability in the construction machine provided with the aqueous urea tank and the battery can be improved as compared with that in the background art.

DESCRIPTION OF EMBODIMENTS

Embodiments of a construction machine according to the invention will be described below with reference to the drawings.

[First Embodiment]

Figure 1:
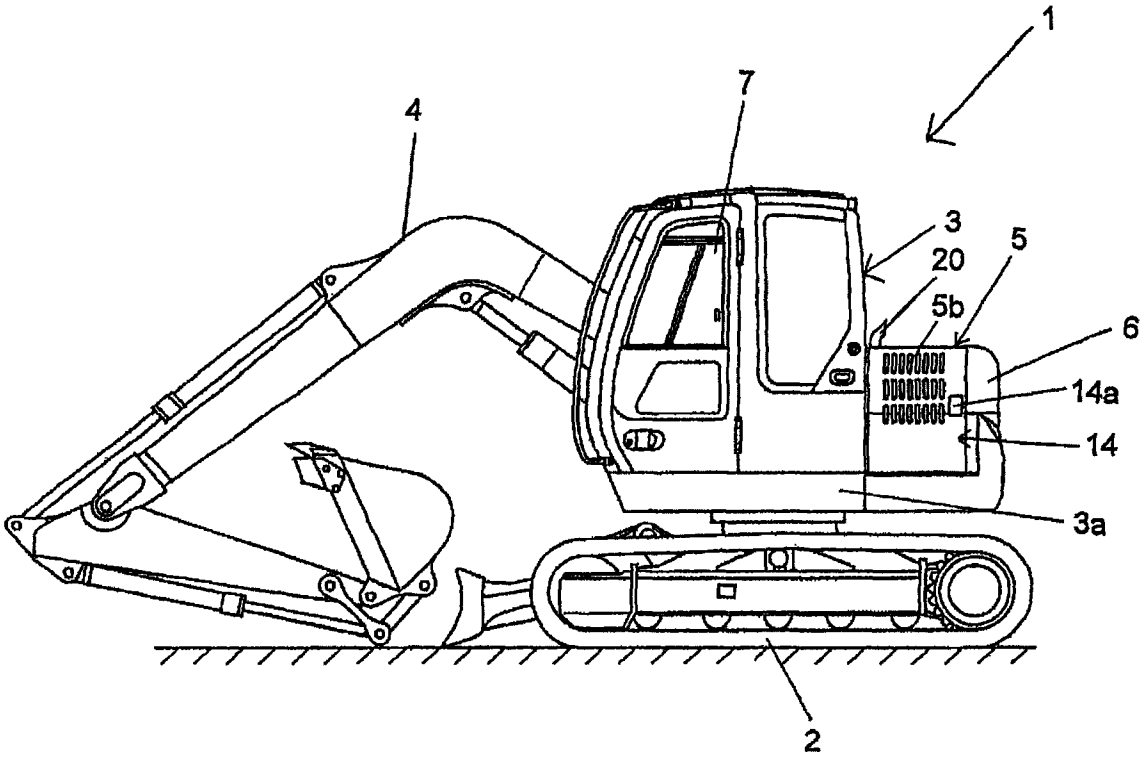
[FIG. 1] A side view showing a small turning type hydraulic excavator as a first embodiment of a construction machine according to the invention.

A first embodiment of a construction machine according to the invention is, for example, applied to a small turning type hydraulic excavator 1 as shown in FIG. 1. The hydraulic excavator 1 has a travel base 2, a turning upperstructure 3 disposed on an upper side of the travel base 2 and having a turning frame 3*a*, and a swing device such as a front work device 4 attached to the front of the turning upperstructure 3 so as to swing to an up/down direction. In addition, the turning upperstructure 3 has a cab 7 in the front thereof and a counterweight 6 at the rear thereof. The turning upperstructure 3 also has an engine room 5 between the cab 7 and the counterweight 6.

In addition, the engine room 5 has an openable and closeable door 14 which can be opened and closed in a left/right direction by means of not-shown hinges in a left front portion. An intake port 5*b* for taking the outside air into the engine room 5 is provided in the openable and closeable door 14. Specifically, the intake port 5*b* is provided in the exterior of the engine room 5 and in an upper portion of the openable and closeable door 14. The intake port 5*b* is formed into a plurality of slits which are set to be long and narrow to prevent large dusts from entering the engine room 5 together with the outside air. A grip 14*a* is attached to the openable and closeable door 14 of the engine room 5 and between the intake port 5*b* and the counterweight 6. When the grip 14*a* is pulled, the openable and closeable door 14 is opened so that maintenance work or the like in the engine room 5 can be performed. Further, a not-shown outlet port through which the outside air taken into the engine room 5 through the intake port 5*b* can be delivered to the outside again is formed in the exterior of the engine room 5 and on an opposite side to the intake port 5*b*.

Figure 2:
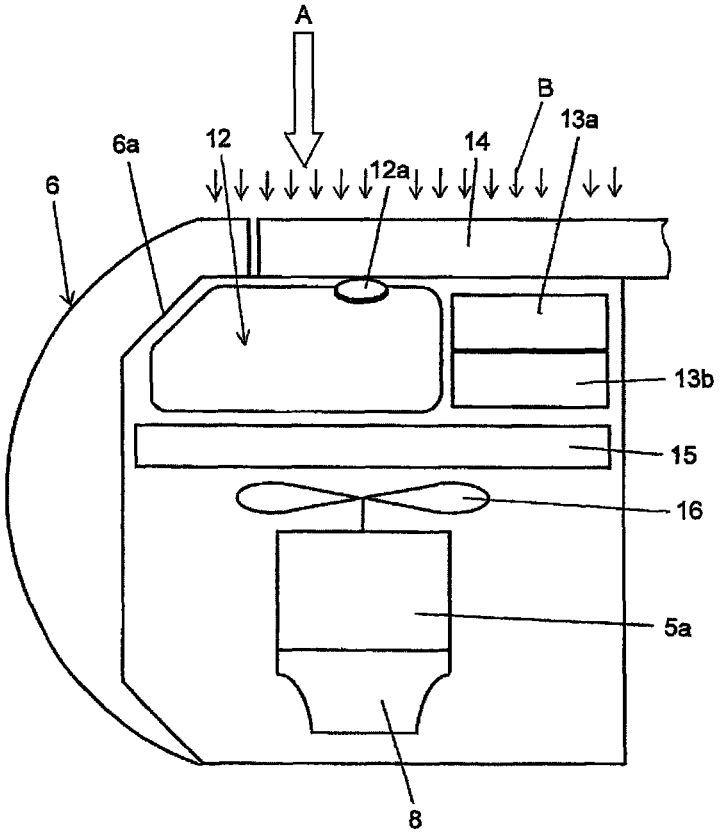
[FIG. 2] A view showing the internal configuration of a turning upperstructure provided in the first embodiment of the construction machine according to the invention.

Further, as shown in FIG. 2, the engine room 5 includes an engine 5*a*, a heat exchanger 15 which exchanges heat with the engine 5*a*, the aforementioned intake port 5*b* which is formed in the exterior of the engine room 5 to take in the outside air therethrough, a fan 16 which is provided at a closer end to the heat exchanger 15 of opposite ends of the engine 5*a* so as to introduce the outside air into the engine room 5 from the intake port 5*b* to thereby cool the heat exchanger 15, a tail pipe 20 which is provided on the exterior of the engine room 5 to release exhaust gas discharged from the engine 5*a* to the outside, and a hydraulic pump 8 which is provided at the other end on the opposite side to the fan 16 of the opposite ends of the engine 5*a* so as to supply pressure oil to the front work device 4.

Specifically, the fan 16 is connected to the engine 5*a* through a not-shown pulley so that the fan 16 can rotate due to the drive power of the engine 5*a*. In addition, though not shown, the heat exchanger 15 has, for example, a radiator which cools cooling water for the engine 5*a*, an oil cooler which cools hydraulic oil for operating the front work device 4, and an intercooler which cools the intake air for the engine 5*a*. These radiator, oil cooler and intercooler are provided side by side in a front/rear direction of the turning upperstructure 3 and supported erectly by a frame fixed on the turning frame 3*a*. The heat exchanger 15 separates a room where the engine 5*a*, the fan 16 and the hydraulic pump 8 are disposed from a room where the aqueous urea tank 12 and batteries 13*a* and 13*b* are disposed as will be described later.

Thus, when the engine 5*a* is driven in the small turning type hydraulic excavator 1, the fan 16 rotates so that the outside air flows into the engine room 5 through the intake port 5*b* formed in the exterior of the engine room 5. Then, the outside air flowing in is delivered to the heat exchanger 15 so as to cool the radiator, the oil cooler and the intercooler of the heat exchanger 15. After that, the outside air is delivered to the engine 5*a* and the hydraulic pump 8 so as to cool the engine 5*a* and the hydraulic pump 8, and delivered to the outside through the outlet port formed in the exterior of the engine room 5.

Here, the counterweight 6 disposed at the rear of the turning upperstructure 3 of the small turning type hydraulic excavator 1 has a shorter tail radius than a standard type hydraulic excavator. For example, the counterweight 6 has a recess portion 6*a* largely sinking inward and is removably attached to the engine room 5. In addition, the counterweight 6 is, for example, molded out of casting to keep balance in the vehicle body. That is, the shape, weight, etc. of the counterweight 6 are adjusted to set the gravity center of the vehicle body near the center of the turning upperstructure 3 so as to prevent the vehicle body from tilting frontward due to the weight of the front work device 4.

Figure 3:
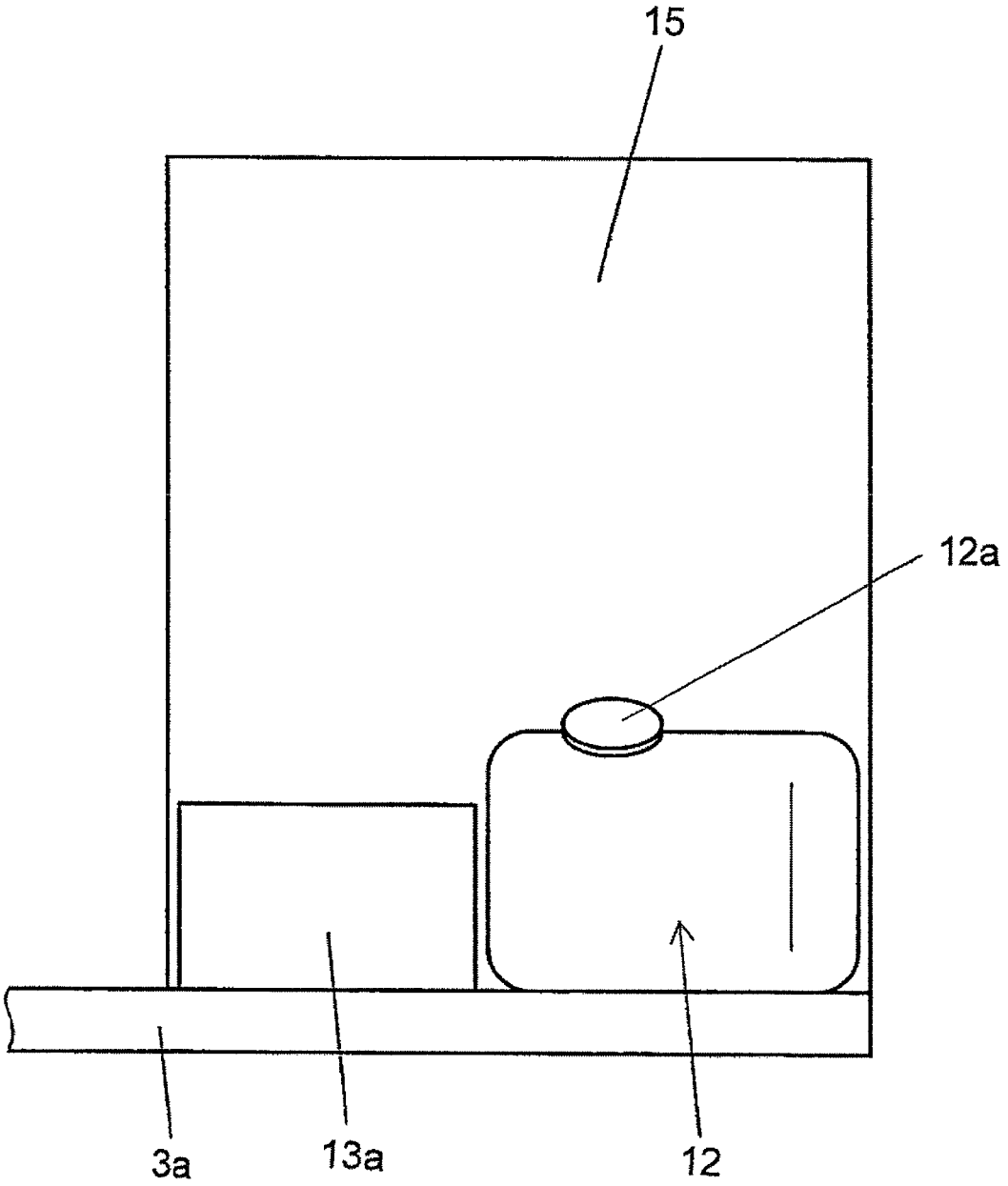
[FIG. 3] An interior view of the turning upperstructure taken in the direction of an arrow A shown in FIG. 2 for explaining the layout of an aqueous urea tank and batteries provided in the first embodiment of the invention shown in FIG. 2.

In the first embodiment of the invention, the engine room 5 has the aforementioned aqueous urea tank 12 for storing aqueous urea that purifies exhaust gas discharged from the engine 5*a*, and two batteries 13*a* and 13*b* for supplying electric power to the engine 5*a* as shown in FIGS. 2 and 3. The aqueous urea tank 12 and the two batteries 13*a* and 13*b* are disposed together on an upstream side of the heat exchanger 15 in a flow direction of the outside air (on an upstream side in a flow direction B of cooling wind, and the same thing can be applied to the following description). That is, in the first embodiment of the invention, the aqueous urea tank 12 and the batteries 13*a* and 13*b* are disposed among the openable and closeable door 14 of the engine room 5, the heat exchanger 15 and the counterweight 6.

In the first embodiment of the invention, for example, the two batteries 13*a* and 13*b* are disposed on a side more closely to the front work device 4 than the aqueous urea tank 12. That is, the aqueous urea tank 12 is disposed at the rear of the two batteries 13*a* and 13*b* in the front/rear direction of the batteries 13*a* and 13*b* and the turning upperstructure 3. Here, each battery 13*a*, 13*b* has a rectangular parallelepiped shape and is set to have the same size and the same battery capacity as the other battery. These batteries 13*a* and 13*b* are disposed in such a manner that longitudinal side faces of the side faces of their rectangular parallelepipeds are opposed to each other. Further, the batteries 13*a* and 13*b* are provided side by side so that the longitudinal directions of the top faces of the rectangular parallelepipeds are parallel to the front/rear direction of the turning upperstructure 3. The batteries 13*a* and 13*b* are fixed onto the turning frame 3*a* by, for example, not-shown securing bands or the like so as not to move.

In addition, a supply port 12*a* for supplying aqueous urea is provided in an upper portion of the aqueous urea tank 12. The supply port 12*a* is disposed on the openable and closeable door 14 side of the engine room 5. Further, the aforementioned aqueous urea tank 12 is, for example, molded out of a synthetic resin material with a high corrosion resistance or molded out of stainless steel or the like. The shape and size of the aqueous urea tank 12 are set in advance so that the aqueous urea tank 12 can be received in a space among the two batteries 13*a* and 13*b*, the openable and closeable door 14, the heat exchanger 15 and the counterweight 6. To this end, the tail side of the aqueous urea tank 12 is molded in conformity to the shape of the recess portion 6*a* of the counterweight 6. Thus, the top face of the aqueous urea tank 12 has a trapezoidal shape with rounded corner portions as shown in FIG. 2, and each side face of the aqueous urea tank 12 has a rectangle with rounded corner portions as shown in FIG. 3. The height of the aqueous urea tank 12 is set to be larger than the height of each battery 13*a*, 13*b*. The aqueous urea tank 12 is fixed onto the turning frame 3*a* by, for example, a not-shown securing band or the like so as not to move.

Though not shown, the engine room 5 also has an exhaust duct which connects the engine 5*a* with the tail pipe 20 so as to introduce the exhaust gas discharged from the engine 5*a* to the exhaust port 20, a reduction catalyst which is provided in the exhaust duct, and an injection device which is disposed in the exhaust duct and on an upstream side of the reduction catalyst so as to inject the aqueous urea supplied from the aqueous urea tank 12 into the exhaust duct. Harmful nitrogen oxide contained in the exhaust gas is decomposed to harmless water and nitrogen by reduction reaction with ammonia produced from the aqueous urea injected by the injection device in the reduction catalyst.

According to the first embodiment of the invention configured thus, the outside air is taken into the engine room 5 through the slit-like intake port 5*b* formed in the openable and closeable door 14 of the engine room 5 so that the temperature in the space on an upstream side of the heat exchanger 15 in the flow direction of the outside air, that is, between the openable and closeable door 14 of the engine room 5 and the heat exchanger 15 may be made close to the temperature of the atmosphere by the taken-in outside air. Therefore, when both the aqueous urea tank 12 and the two batteries 13*a* and 13*b* are disposed in the space between the openable and closeable door 14 of the engine room 5 and the heat exchanger 15, the aqueous urea tank 12 and the two batteries 13*a* and 13*b* can be cooled by the outside air taken in through the intake port 5*b* even if the aqueous urea tank 12 and the two batteries 13*a* and 13*b* are placed in a portion which may reach a high temperature in the engine room 5, for example, near a device such as the engine 5*a* or the hydraulic pump 8 generating heat. Thus, the temperature rise in the aqueous urea within the aqueous urea tank 12 and the batteries 13*a* and 13*b* can be suppressed.

In addition, since both the aqueous urea tank 12 and the two batteries 13*a* and 13*b* are placed within the engine room 5, the counterweight 6 can ensure enough weight to keep balance in the vehicle body. Further, since the aqueous urea tank 12 and the two batteries 13*a* and 13*b* are placed within the engine room 5, the weight of the front work device 4 and the weight of the counterweight 6 are balanced so that the displacement of the gravity center located near the center of the turning upperstructure 3 can be suppressed. Thus, the balance in the vehicle body can be kept even when the small turning type hydraulic excavator 1 has the aqueous urea tank 12 and the batteries 13*a* and 13*b*. In this manner, the temperature rise in the aqueous urea within the aqueous urea tank 12 and the batteries 13*a* and 13*b* can be suppressed while high stability can be secured in the vehicle body. It is therefore possible to improve the reliability of the small turning type hydraulic excavator 1 having the aqueous urea tank 12 and the batteries 13*a* and 13*b*.

In addition, in the first embodiment of the invention, the two batteries 13*a* and 13*b* are disposed on a side more closely to the front work device 4 than the aqueous urea tank 12. Thus, a space for placing the aqueous urea tank 12 therein is ensured at the rear of the batteries 13*a* and 13*b*, that is, on a side more closely to the counterweight 6 than the batteries 13*a* and 13*b*. Accordingly, when the shape and size of the aqueous urea tank 12 are set in conformity with the shape of the recess portion 6*a* largely sinking inward in the counterweight 6 in this space and the aqueous urea tank 12 is placed in the space, a new dead space can be prevented from being formed due to both the aqueous urea tank 12 and the batteries 13*a* and 13*b* disposed on the upstream side of the heat exchanger 15 in the flow direction of the outside air. Thus, the space within the engine room 5 can be used effectively.

In addition, in the first embodiment of the invention, the two batteries 13*a* and 13*b* are provided side by side on a side more closely to the front work device 4 than the aqueous urea tank 12. Accordingly, as shown in FIG. 3, the portion above the aqueous urea tank 12 and the batteries 13*a* and 13*b* is open. Therefore, even if both the aqueous urea tank 12 and the batteries 13*a* and 13*b* are disposed on the upstream side of the heat exchanger 15 in the flow direction of the outside air, the aqueous urea tank 12 and the batteries 13*a* and 13*b* can be prevented from interfering with the flow of the outside air flowing into the engine room 5 through the intake port 5*b*. In this manner, an enough flow rate of the outside air can be delivered to the heat exchanger 15, the engine 5*a* and the hydraulic pump 8 through the intake port 5*b*.

[Second Embodiment]

Figure 4:
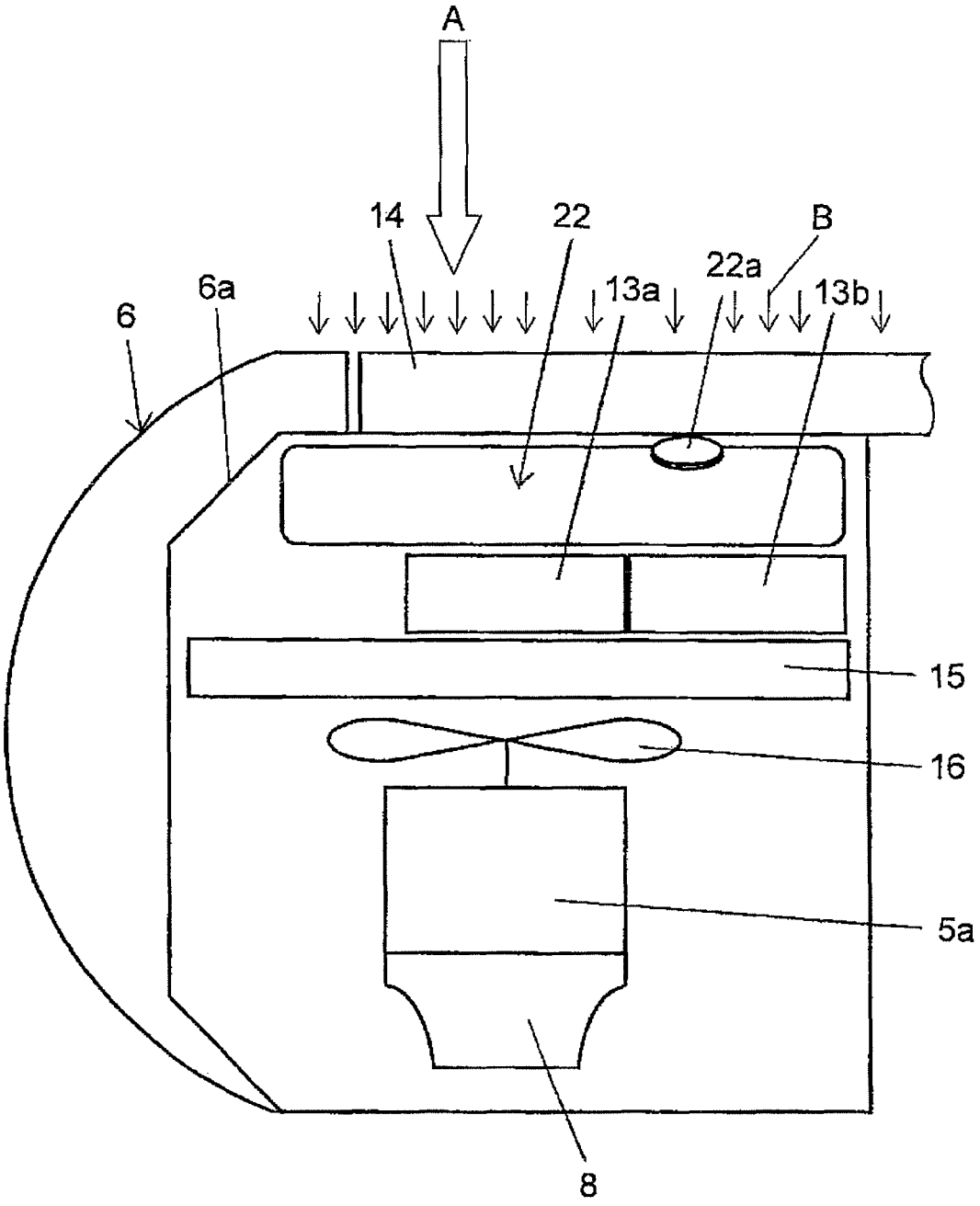
[FIG. 4] A view showing the internal configuration of a turning upperstructure provided in a second embodiment of a construction machine according to the invention.
Figure 5:
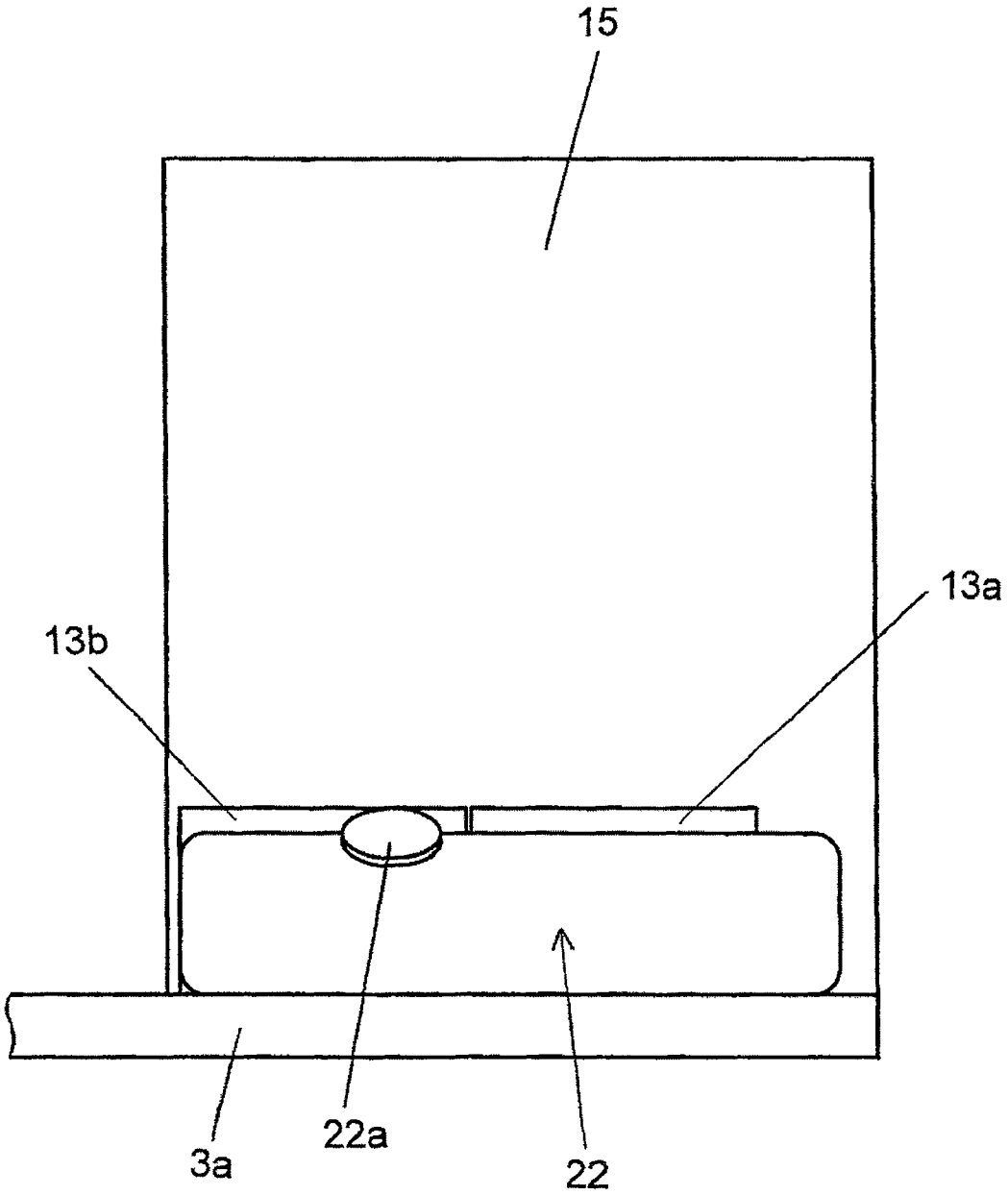
[FIG. 5] An interior view of the turning upperstructure taken in the direction of an arrow A shown in [FIG. 4] for explaining the layout of an aqueous urea tank and batteries provided in the second embodiment of the invention shown in FIG. 4.

FIG. 4 is a view showing the internal configuration of a turning upperstructure provided in a second embodiment of a construction machine according to the invention. FIG. 5 is an interior view of the turning upperstructure taken in the direction of an arrow A shown in FIG. 4 for explaining the layout of an aqueous urea tank and batteries provided in the second embodiment of the invention shown in FIG. 4.

The second embodiment of the invention is different from the aforementioned first embodiment as follows. That is, in the first embodiment, the two batteries 13*a* and 13*b* are disposed on a side more closely to the front work device 4 than the aqueous urea tank 12 as shown in FIGS. 2 and 3, whereas in the second embodiment, the two batteries 13*a* and 13*b* are disposed between an aqueous urea tank 22 and the heat exchanger 15 as shown in FIGS. 4 and 5.

In this case, the two batteries 13*a* and 13*b* are disposed in such a manner that lateral side faces of the side faces of their rectangular parallelepipeds are opposed to each other. Further, the batteries 13*a* and 13*b* are provided side by side so that the longitudinal directions of the top faces of the rectangular parallelepipeds are parallel to the front/rear direction of the turning upperstructure 3. In addition, the batteries 13*a* and 13*b* are disposed adjacently to the heat exchanger 15, and the aqueous urea tank 22 is disposed in a space between the openable and closeable door 14 of the engine room 5 and the batteries 13*a* and 13*b*. To this end, the shape and size of the aqueous urea tank 22 are set in advance so that the aqueous urea tank 22 can be received in the aforementioned space among the two batteries 13*a* and 13*b*, the openable and closeable door 14 and the counterweight 6. To this end, the top face of the aqueous urea tank 22 is shaped into a rectangle with rounded corner portions as shown in FIG. 4, and each side face of the aqueous urea tank 22 is shaped into a rectangle with rounded corner portions as shown in FIG. 5. The height of the aqueous urea tank 22 is set to be smaller than the height of each battery 13*a*, 13*b*. The other configuration is the same as that in the first embodiment.

According to the second embodiment of the invention configured thus, the two batteries 13*a* and 13*b* are disposed between the aqueous urea tank 22 and the heat exchanger 15 so that the aqueous urea tank 22 is disposed on an outer side than the batteries 13*a* and 13*b*, that is, on a side more closely to the openable and closeable door 14 of the engine room 5. Thus, when the grip 14*a* provided in the openable and closeable door 14 is held to open the openable and closeable door 14, one can stretch his/her hand to a supply port 22*a* of the aqueous urea tank 22 easily. Further, since the height of the aqueous urea tank 22 is set to be smaller than the height of each battery 13*a*, 13*b*, it is easy to inject the aqueous urea into the supply port 22*a* of the aqueous urea tank 22 from the outside of the turning upperstructure 3. In this manner, the labor and time required for the maintenance work including supply with the aqueous urea etc. in the aqueous urea tank 22 can be saved so that user-friendliness in the maintenance work can be enhanced.

[Third Embodiment]

Figure 6:
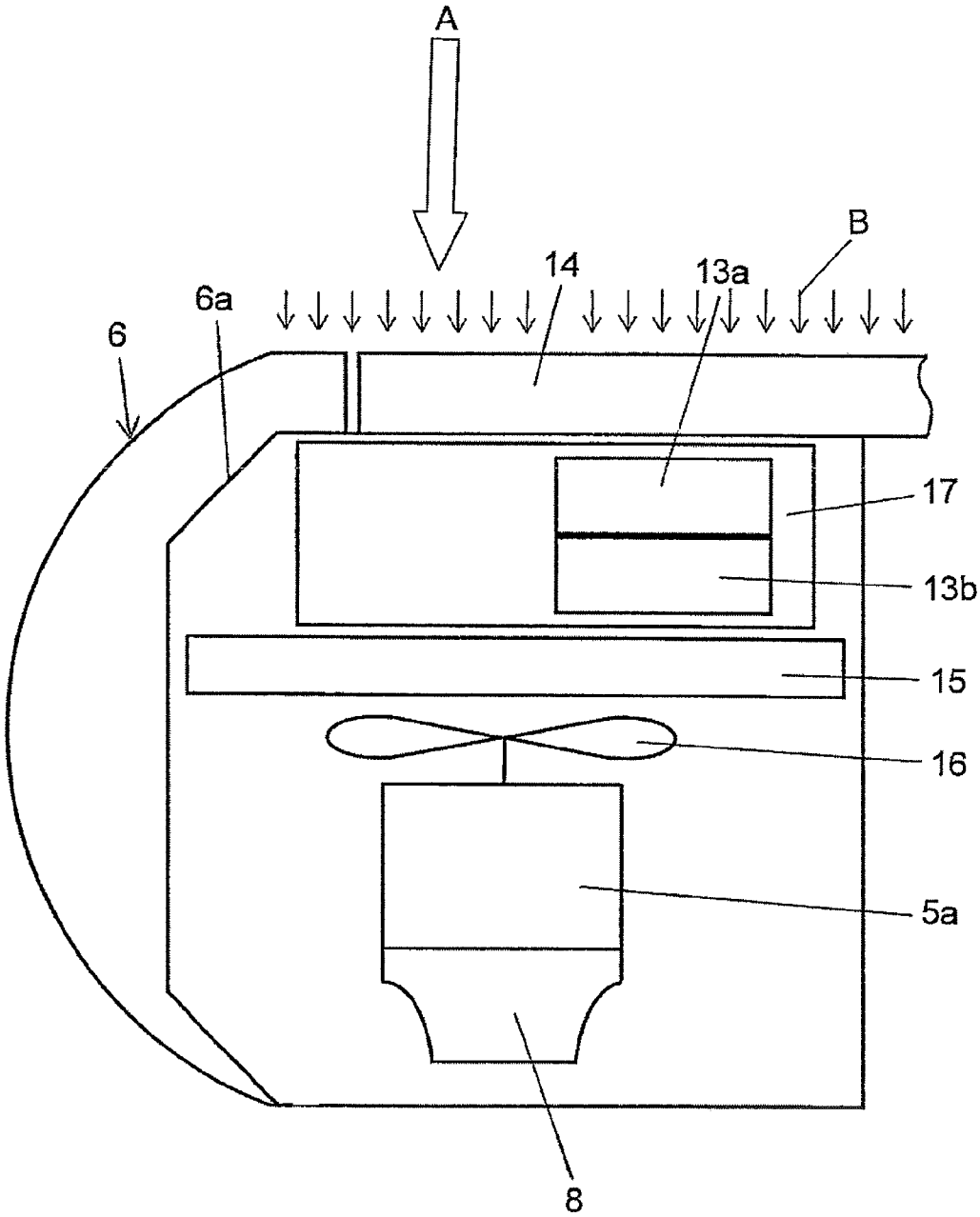
[FIG. 6] A view showing the internal configuration of a turning upperstructure provided in a third embodiment of a construction machine according to the invention.
Figure 7:
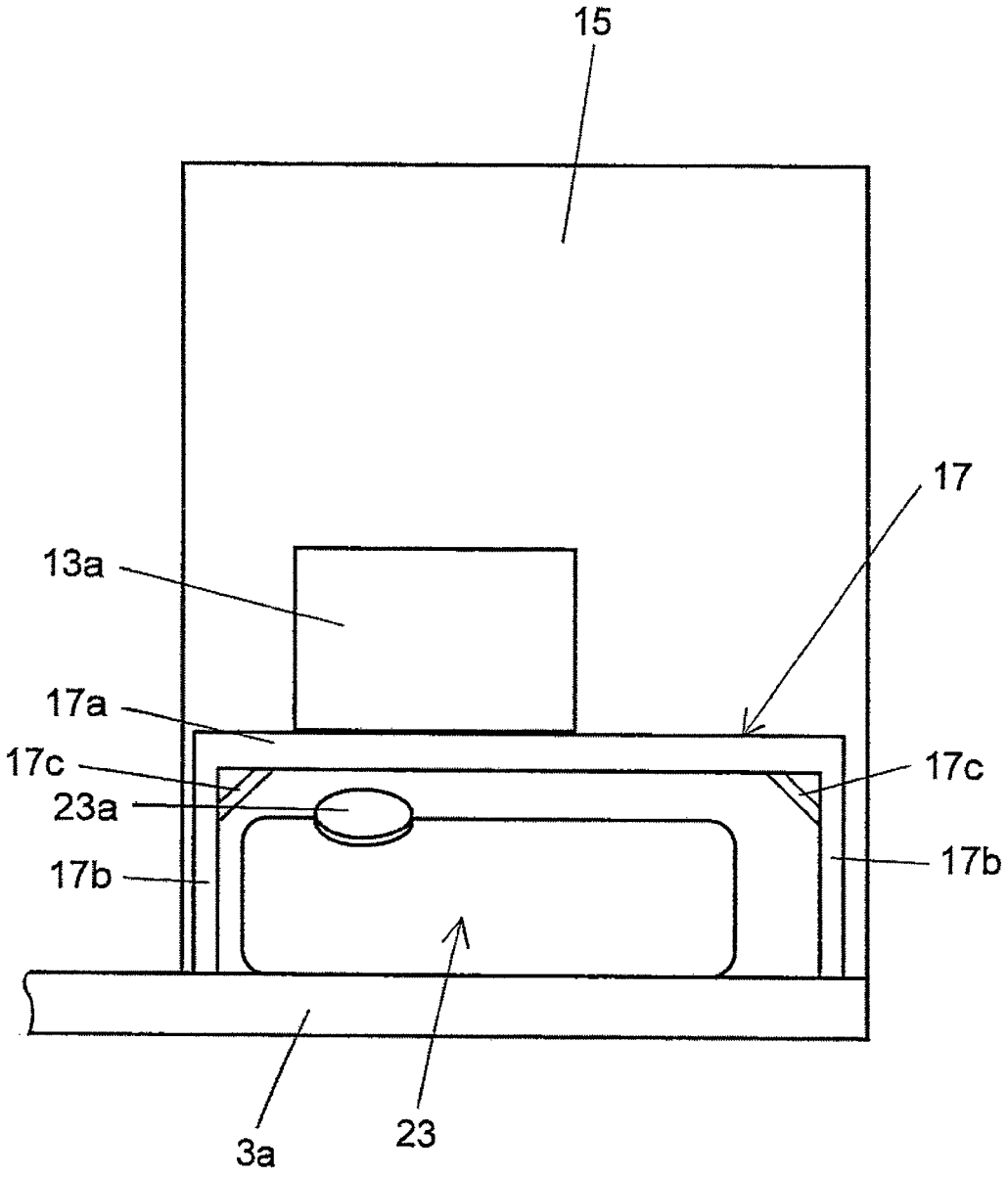
[FIG. 7] An interior view of the turning upperstructure taken in the direction of an arrow A shown in FIG. 6 for explaining the layout of an aqueous urea tank and batteries provided in the third embodiment of the invention shown in FIG. 6.
Figure 8:
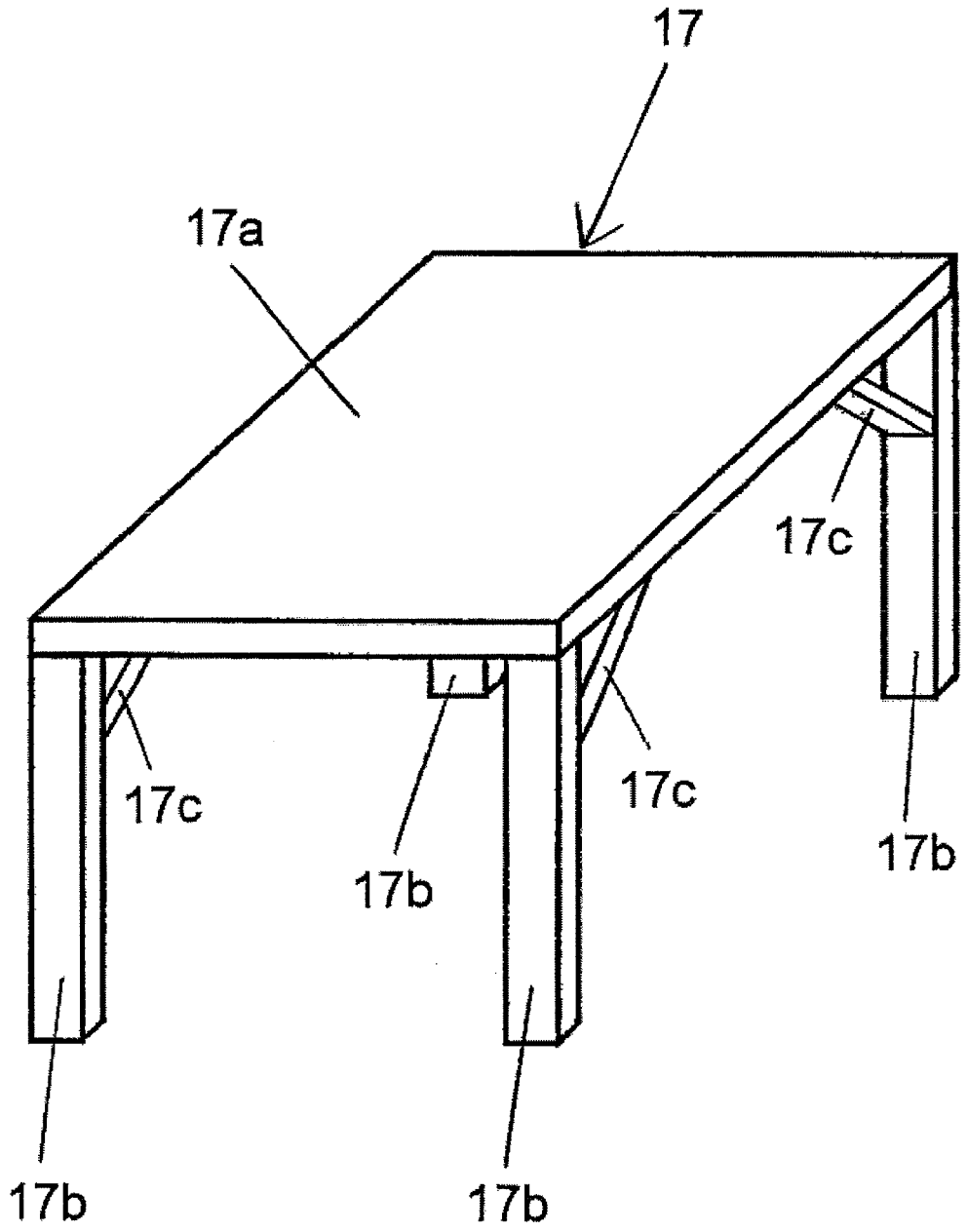
[FIG. 8] A view showing the configuration of a support base provided in the third embodiment of the invention shown in FIG. 7.

FIG. 6 is a view showing the internal configuration of a turning upperstructure provided in a third embodiment of a construction machine according to the invention. FIG. 7 is an interior view of the turning upperstructure taken in the direction of an arrow A shown in FIG. 6 for explaining the layout of an aqueous urea tank and batteries provided in the third embodiment of the invention shown in FIG. 6. FIG. 8 is a view showing the configuration of a support base provided in the third embodiment of the invention shown in FIG. 7.

The third embodiment of the invention is different from the aforementioned first embodiment as follows. That is, in the first embodiment, the two batteries 13*a* and 13*b* are disposed on a side more closely to the front work device 4 than the aqueous urea tank 12 as shown in FIGS. 2 and 3, whereas in the third embodiment, the two batteries 13*a* and 13*b* are disposed above an aqueous urea tank 23 as shown in FIGS. 6 and 7.

Specifically, in the third embodiment of the invention, a support base 17 for supporting the batteries 13*a* and 13*b* from below is provided. As shown in FIG. 8, the support base 17 is constituted by a rectangular flat plate 17*a* on which the batteries 13*a* and 13*b* will be mounted, four supports 17*b* which are disposed in four corner portions of the flat plate 17*a* and provided perpendicularly to the flat plate 17*a* respectively, and four support pieces 17*c* which support the flat plate 17*a* and the supports 17*b* respectively.

In addition, as shown in FIG. 6, the longitudinal length of the flat plate 17*a* is set to be larger than the longitudinal length of the top face of each battery 13*a*, 13*b*, and the lateral length of the flat plate 17*a* is set to be larger than twice of the lateral length of the top face of each battery 13*a*, 13*b* and smaller than the distance between the openable and closeable door 14 of the engine room 5 and the heat exchanger 15. The support base 17 is disposed among the openable and closeable door 14, the heat exchanger 15 and the counterweight 6, and the back face of each support piece 17*c* is fixed to the turning frame 3*a* by welding or the like.

The batteries 13*a* and 13*b* are disposed in such a manner that longitudinal side faces of the side faces of their rectangular parallelepipeds are opposed to each other in the same manner as in the first embodiment. Further, the batteries 13*a* and 13*b* are provided side by side on the flat plate 17*a* of the support base 17 so that the longitudinal directions of the top faces of the rectangular parallelepipeds are parallel to the front/rear direction of the turning upperstructure 3. The batteries 13*a* and 13*b* are fixed onto the flat plate 17*a* of the support base 17 by, for example, not-shown securing bands or the like so as not to move. The aqueous urea tank 23 is disposed under the flat plate 17*a* of the support base 17.

Accordingly, the shape and size of the aqueous urea tank 23 are set in advance so that the aqueous urea tank 23 can be received in the space formed under the flat plate 17*a* of the support base 17. To this end, the top face of the aqueous urea tank 22 is shaped into a rectangle with rounded corner portions, and each side face of the aqueous urea tank 22 is shaped into a rectangle with rounded corner portions as shown in FIG. 7. The height of the aqueous urea tank 23 is set to be smaller than the length of each support 17*b* of the support base 17. The other configuration is the same as that in the first embodiment.

According to the third embodiment of the invention configured thus, a space corresponding to the size of the batteries 13*a* and 13*b* can be ensured newly on the turning frame 3*a* in comparison with the case where the aqueous urea tank 12, 22 and the batteries 13*a* and 13*b* are disposed side by side as in the first or second embodiment. Accordingly, the volume of the aqueous urea tank 23 can be set to be larger by the space corresponding to the size of the batteries 13 and 13*b* and secured on the turning frame 3*a*. In this manner, an enough quantity of aqueous urea can be stored in the aqueous urea tank 23.

In addition, the height of the aqueous urea tank 23 is set to be smaller than the length of each support 17*b* of the support base 17 as described above, so that the height of the aqueous urea tank 23 can be suppressed even if the volume of the aqueous urea tank 23 is set to be large. Accordingly, the aqueous urea can be easily injected into the supply port 23*a* of the aqueous urea tank 23 from the outside of the turning upperstructure 3 when the openable and closeable door 14 of the engine room 5 is opened. In this manner, it is possible to reduce the burden on a worker in maintenance work including supply with the aqueous urea etc.

[Fourth Embodiment]

Figure 9:
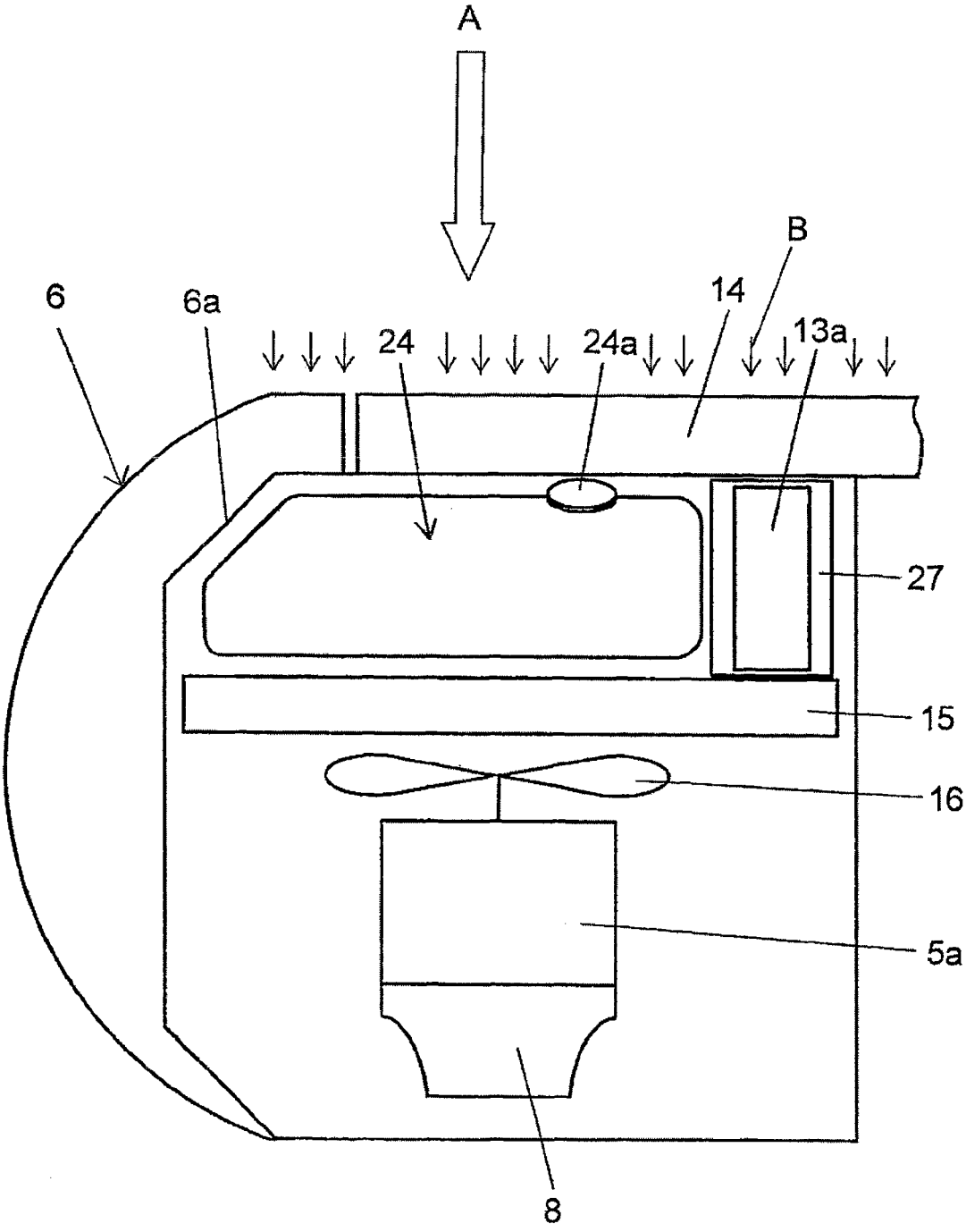
[FIG. 9] A view showing the internal configuration of a turning upperstructure provided in a fourth embodiment of a construction machine according to the invention.
Figure 10:
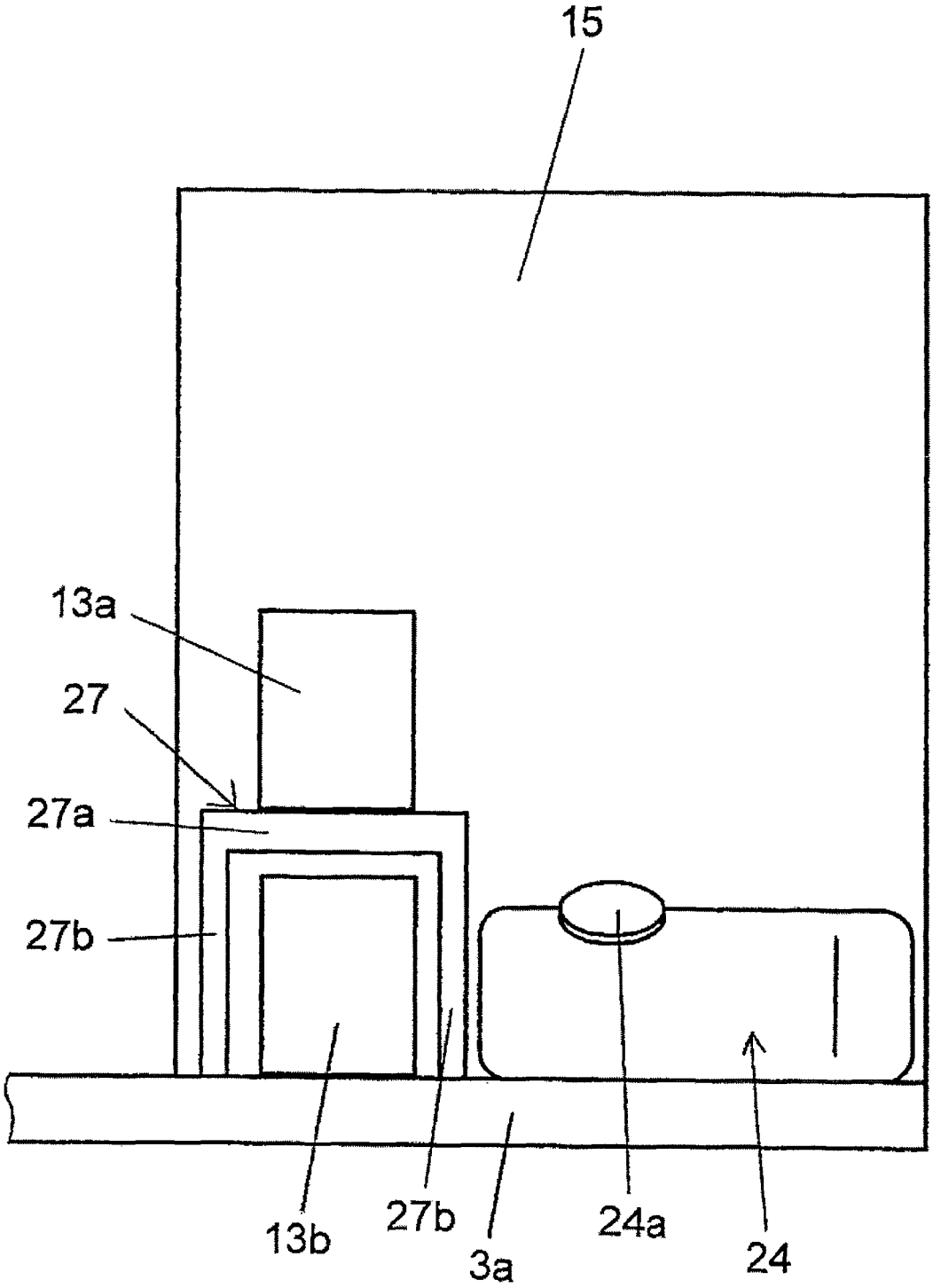
[FIG. 10] An interior view of the turning upperstructure taken in the direction of an arrow A shown in FIG. 9 for explaining the layout of an aqueous urea tank and batteries provided in the fourth embodiment of the invention shown in FIG. 9.

FIG. 9 is a view showing the internal configuration of a turning upperstructure provided in a fourth embodiment of a construction machine according to the invention. FIG. 10 is an interior view of the turning upperstructure taken in the direction of an arrow A shown in FIG. 9 for explaining the layout of an aqueous urea tank and batteries provided in the fourth embodiment of the invention shown in FIG. 9.

The fourth embodiment of the invention is different from the aforementioned first embodiment as follows. That is, in the first embodiment, the two batteries 13*a* and 13*b* are disposed on the turning frame 3*a* on a side more closely to the front work device 4 than the aqueous urea tank 12 as shown in FIGS. 2 and 3, whereas in the fourth embodiment, not only are the two batteries 13*a* and 13*b* disposed on a side more closely to the front work device 4 than the aqueous urea tank 12 in the same manner as in the first embodiment, but also one battery 13*a* of the two batteries 13*a* and 13*b* is disposed above the other battery 13*b*, for example, as shown in FIGS. 9 and 10.

In this case, according to the fourth embodiment of the invention, a support base 27 having a flat plate 27*a* whose size is different from that of the flat plate 17*a* of the support base 17 is provided in place of the support base 17 provided in the third embodiment. That is, as shown in FIG. 9, the longitudinal length of the flat plate 27*a* is set to be a little larger than the longitudinal length of the top face of each battery 13*a*, 13*b* and smaller than the distance between the openable and closeable door 14 of the engine room 5 and the heat exchanger 15, and the lateral length of the flat plate 27*a* is set to be a little larger than the lateral length of the top face of each battery 13*a*, 13*b*.

The support base 27 is disposed among the openable and closeable door 14, the heat exchanger 15, the counterweight 6 and an aqueous urea tank 24, so that the longitudinal direction of the flat plate 27*a* is perpendicular to the front/rear direction of the turning upperstructure 3. The back face of each support 27*b* is fixed to the turning frame 3*a* by welding or the like. Thus, one battery 13*b* of the two batteries 13*a* and 13*b* is disposed under the flat plate 27*a* of the support base 27 so that the longitudinal direction of the top face of its rectangular parallelepiped is perpendicular to the front/rear direction of the turning upperstructure 3, and the other battery 13*a* is disposed on the flat plate 27*a* of the support base 27 so that the longitudinal direction of the top face of its rectangular parallelepiped is perpendicular to the front/rear direction of the turning upperstructure 3. The battery 13*b* is fixed onto the turning frame 3*a* by, for example, a not-shown securing band or the like, and the battery 13*a* is fixed onto the flat plate 27*a* of the support base 27 by, for example, a not-shown securing band or the like. The other configuration is the same as that in the first embodiment.

According to the fourth embodiment of the invention configured thus, one battery 13*a* of the two batteries 13*a* and 13*b* is disposed above the other battery 13*b* by means of the support base 27, so that a space corresponding to the size of one battery 13*a* can be secured on the turning frame 3*a* in comparison with the case where the aqueous urea tank 12 and the two batteries 13*a* and 13*b* are disposed side by side on the turning frame 3*a* as in the first embodiment shown in FIG. 2. In this manner, the volume of the aqueous urea tank 24 can be set to be larger by the space corresponding to the size of one battery 13*a* and secured on the turning frame 3*a* so that an enough quantity of aqueous urea can be stored in the aqueous urea tank 24. Further, the aqueous urea tank 24 and the batteries 13*a* and 13*b* can be prevented from interfering with the flow of the outside air taken in through the intake port 5*b* in comparison with the case where the two batteries 13*a* and 13*b* are disposed above the aqueous urea tank 23 as in the third embodiment shown in FIG. 6.

The aforementioned first to third embodiments of the invention have been described in the case where the two batteries 13*a* and 13*b* are disposed on the upstream side of the heat exchanger 15 in the flow direction of the outside air. However, one battery or three or more batteries may be disposed on the upstream side of the heat exchanger 15 in the flow direction of the outside air. Also in this case, the size of the aqueous urea tank may be set so that the aqueous urea tank can be received in a space on the upstream side of the heat exchanger 15 in the flow direction of the outside air in the engine room 5.

In addition, the first to fourth embodiments of the invention have been described in the case where they are applied to the small turning type hydraulic excavator 1 as shown in FIG. 1. However, the invention may be also applied to a construction machine such as a middle-sized or larger hydraulic excavator.

REFERENCE SIGNS LIST

1 small turning type hydraulic excavator (construction machine)
2 travel base
3 turning upperstructure
4 front work device (work device)
5 engine room
5*a* engine
5*b* intake port
6 counterweight
7 cab

8 hydraulic pump
12,22,23,24 aqueous urea tank
12*a*,22*a*,23*a*,24*a* supply port
13*a*,13*b* battery
14 openable and closeable door
14*a* grip
15 heat exchanger
16 fan
17,27 support base
17*a*, 27*a* flat plate
17*b*,27*b* support
17*c*,27*c* support piece
20 tail pipe

The invention claimed is:

1. A construction machine comprising: a turning upperstructure which is provided with a work device in a front thereof; a counterweight which is disposed at a rear of the turning upperstructure; an engine room which is disposed in front of the counterweight; an engine which is disposed within the engine room; a heat exchanger which exchanges heat with the engine; an intake port which is formed in an exterior of the engine room to take in outside air therethrough; a fan which introduces the outside air from the intake port into the engine room to cool the heat exchanger; a tail pipe which is disposed on the exterior of the engine room to release exhaust gas discharged from the engine to the outside; an aqueous urea tank which stores aqueous urea that purifies the exhaust gas discharged from the engine; and a battery; wherein:

the counterweight has a recess portion which is formed such that a side facing the engine sinks inward away from the work device;

both the aqueous urea tank and the battery are disposed in a space within the engine room on an upstream side of the heat exchanger in a flow direction of the outside air, the battery is disposed on a side more closely to the work device than the aqueous urea tank, and the aqueous urea tank is disposed on a side more closely to the counterweight than the battery; and a tail side of the aqueous urea tank is formed in conformity to a shape of the recess portion of the counterweight.

2. A construction machine according to claim 1, wherein: the battery is disposed above the aqueous urea tank.

3. A construction machine according to claim 1, wherein: another battery the same as the battery is further provided; and one of the two batteries is disposed above the other battery.

* * * * *